United States Patent [19]

Krogsrud

[11] 4,280,172

[45] Jul. 21, 1981

[54] LAMP

[76] Inventor: Jens C. Krogsrud, Ekelyveien 10, Oslo 3, Norway

[21] Appl. No.: 89,909

[22] Filed: Oct. 31, 1979

[51] Int. Cl.[3] ..... F21V 21/26

[52] U.S. Cl. ..... 362/269; 362/285; 362/371; 362/427

[58] Field of Search ..... 362/269, 275, 285, 371, 362/413, 418, 427, 430, 804

[56] References Cited

U.S. PATENT DOCUMENTS

| | | | |
|---|---|---|---|
| Re. 24,258 | 12/1956 | Burliuk | 362/269 |
| 3,476,925 | 11/1969 | Adra | 362/269 |
| 4,080,530 | 3/1978 | Krogsrud | 362/427 |
| 4,177,504 | 12/1979 | Henderson | 362/371 |

*Primary Examiner*—Donald P. Walsh
*Attorney, Agent, or Firm*—Harold L. Stults

[57] ABSTRACT

An electric lamp which provides substantially uniform lighting throughout a work area. The area extends from directly under the lamp a substantial distance beyond the shade. A faceted reflector provides the desired distribution of the light.

10 Claims, 7 Drawing Figures

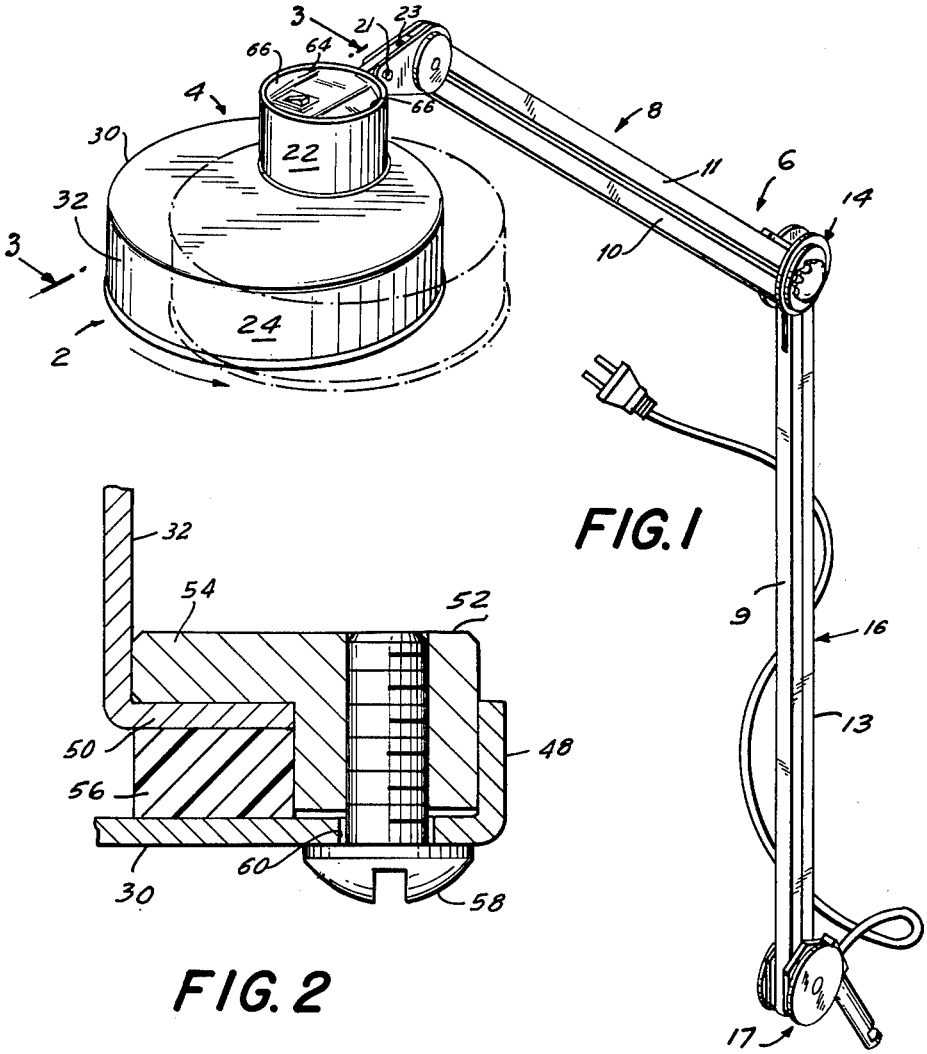
FIG. 1
FIG. 2
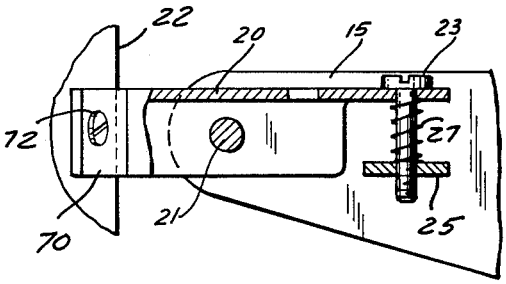
FIG. 7

LAMP

This invention relates to electric lamps, and more in particular to work lamps which are adapted to provide uniform lighting over a work area. The term "work area" is used in the sense of an area where "local" lighting is provided throughout a limited area, such as on a desk or table.

An object of this invention is to provide improved lighting conditions, including insuring uniformity throughout an area and to avoiding glare. A further object is to provide acceptable lighting conditions while permitting a reduction in the power consumed and in the resultant operating costs. A still further object is to provide for the above with constructions which are light in weight, inexpensive to manufacture and operate, attractive in appearance and adaptable to various conditions of use. These and other objects will be in part obvious and in part pointed out below.

A very important factor in lighting is to provide maximum "contrast", for example, so that the printing stands out clearly from the background surface. Accordingly, with the present invention, it is contemplated that a work room can be provided with relatively low general lighting, and that each work area within the room will be provided with uniform "local" lighting. Preferably, the general lighting is at a level below that required in the work area. The eyes of a person at a work area then will adjust to the level required for optimum viewing within the work area. The lighting should also be such that it does not produce objectionable glare due to reflection of the light from the work area to the eyes.

IN THE DRAWINGS

FIG. 1 is a perspective view of a lamp constituting one embodiment of the invention;

FIG. 2 is an enlarged section of the portion 3-3 of FIG. 3;

FIG. 7 is a broken-away view showing the bracket support for the lamp and head at the top of FIG. 1.

Figure 3:
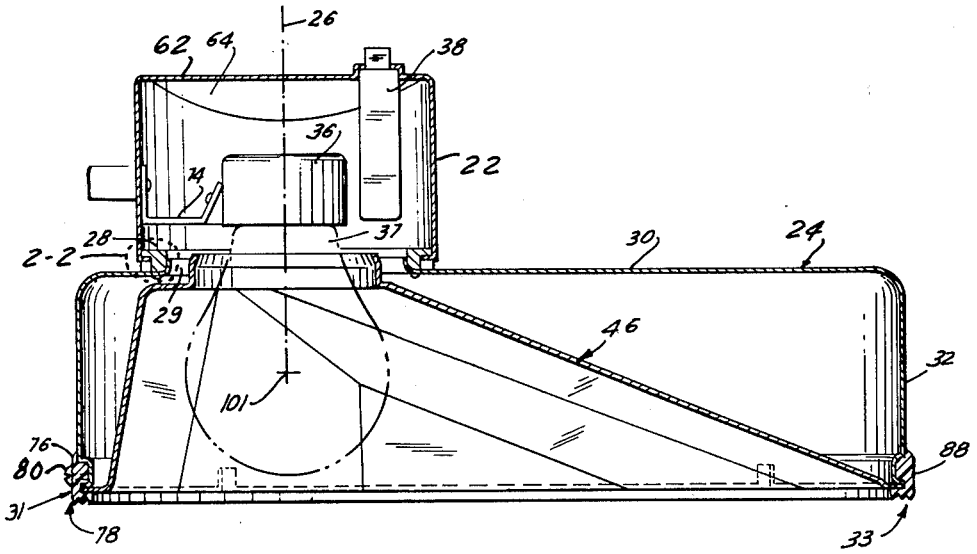
FIG. 3 is a somewhat enlarged vertical central sectional view of the lamp head shown at the right in FIG. 1, the view being parallel to the plane of FIG. 1.

Referring to FIG. 1 of the drawings, a lamp 2 has a lamp head 4 and is supported upon the free end of an arm assembly 6. Arm assembly 6 is of the type disclosed in U.S. Pat. No. 4,080,530, and the present invention includes an improved lamp head and means mounting the lamp head on the arm assembly. The arm assembly includes an upper arm unit 8 and a lower arm unit 16, each unit being formed by a pair of square tubular arms, 10,11 and 15,16, respectively. Unit 8 is connected by a bracket 14 to arm unit 16 which is mounted at its other end upon a swivel bracket 17. Bracket 17 is pivotally supported to swing about a vertical axis in a mounting-clamp bracket 19. Each of the arm units is counterbalanced by springs enclosed within one arm of the arm assembly. Lamp head 4 is counter-balanced against the action of gravity while it is in any position in which it is moved manually. It can be swung vertically through a substantial arc and also around the vertical axis formed by a bracket (not shown). Lamp head 4 has a cylindrical switch box 22 and a shade 24 which has a circular top wall 30 and a peripheral side wall 32 and is swingably mounted upon the bottom of the box so as to be swung around the vertical axis 26 (see FIG. 3). A bracket 20 (see FIG. 7) is mounted upon the side of box 22 and supports the lamp head in bracket 15. Spindle 20 does not pivot freely around its axis but is adjustable to permit precise positioning of shade 24 in a horizontal plane, and the shade then remains in that plane even when moved vertically and horizontally. Referring to FIG. 7, the channel bracket 20 is pivoted on a bulb 21 in bracket 15 and an adjusting screw 23 extends through the end of the bracket and is threaded in a ledge (not shown). A coil spring (not shown) is positioned between bracket 20 and the ledge so as to push upwardly on the bracket. Therefore, turning screw 23 swings bracket 20 around the pivot formed by bolt 21 and that swings the lamp head relative to the horizontal.

Box 22 (see FIG. 3) encloses an electric bulb socket 36 in which a bulb 37 is threaded, and a switch 38 which is operated to turn the bulb on and off. The bottom of the box has a circular opening 28 the center of which is on axis 26. Opening 28 is concentric with an opening 29 in the shade top wall 30 which is adjacent one edge 31 of top wall 30 and remote from the opposite edge 33. Bulb 37 has its neck positioned in openings 28 and 29, and its bulb portion is positioned within the shade. The precise positioning of the bulb is important for the reasons to be discussed below.

Figure 6:
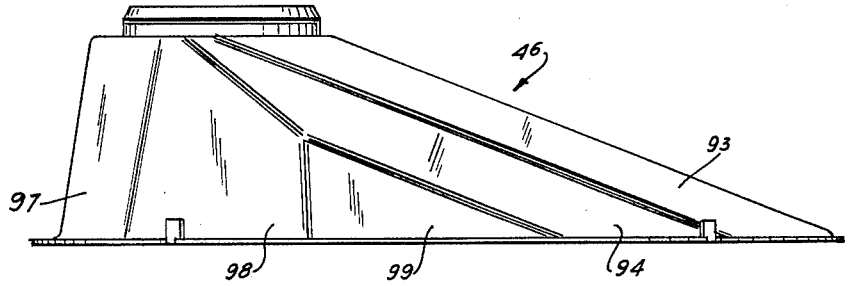
FIG. 6 is a side view of the reflector from the bottom of FIG. 4.

Mounted within shade 5 is a reflector 46 which is of sheet metal with a highly polished exposed surface. Reflector 46 is formed into a plurality of flat portions (see FIGS. 4, 5 and 6), with each portion presenting a reflecting facet which reflects light from bulb 37 in a manner which will be discussed more fully below. Surrounding opening 29 in shade 5 there is an upwardly extending annular flange 48 (see FIG. 2), and the bottom edge of box 22 has an inwardly turned flange 50 which surrounds flange 48. A nylon annular ring 52 surrounds flange 48 and has a horizontal rib 54 which is positioned with its bottom top surface mating with flange 50 and its cylindrical outer surface positioned against the inside surface of box 22. A glider ring 56 is positioned between flange 50 and the adjacent top surface of the top wall 33 of the shade. Four screws 58 extend upwardly through holes 60 in the shade top wall 30 and are threaded into ring 52. Hence, ring 52 is fixed to and supports shade 5, with rib 54 of the ring resting upon flange 50. With flange 50 positioned between rib 54 and glider ring 56, a low-friction support is provided for the shade so that it can be turned easily around the vertical axis of opening 40.

The top wall 62 of box 30 is cut away adjacent opposite sides of its side wall to form arcuate slits, and the wall portions 64 along those slits are deformed downwardly. That forms two vents 66 so that heated air from the bulb can escape upwardly through box 30. Spindle 32 is formed of sheet metal with an inverted channel portion 68 projecting from box 30, and a pair of flanges 70 resting against the cylindrical wall of box 30 and clamped thereto by a pair of screws 72. Socket 36 is mounted upon a sheet metal bracket 74 which is mounted by screws 72 upon the inside surface of the box wall.

Reflector 46 fits in shade 24 and is held in place by an annular strip 76 which extends around the peripheries of the bottom edges of the shade and the reflector. Strip 76 has a bottom horizontal portion 78 which extends beneath the edge of the reflector and an upper portion 88 which nests into an annular groove formed around the bottom edge of the shade. The ends of strip 76 are secured by screws 80.

Figure 4:
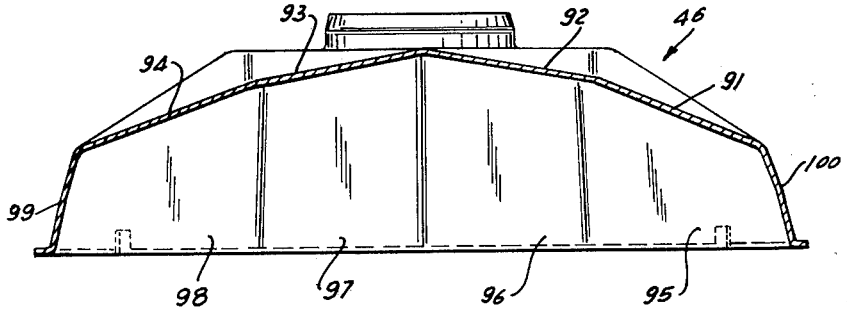
FIG. 4 is a sectional view on the line 4-4 of FIG. 6.
Figure 5:
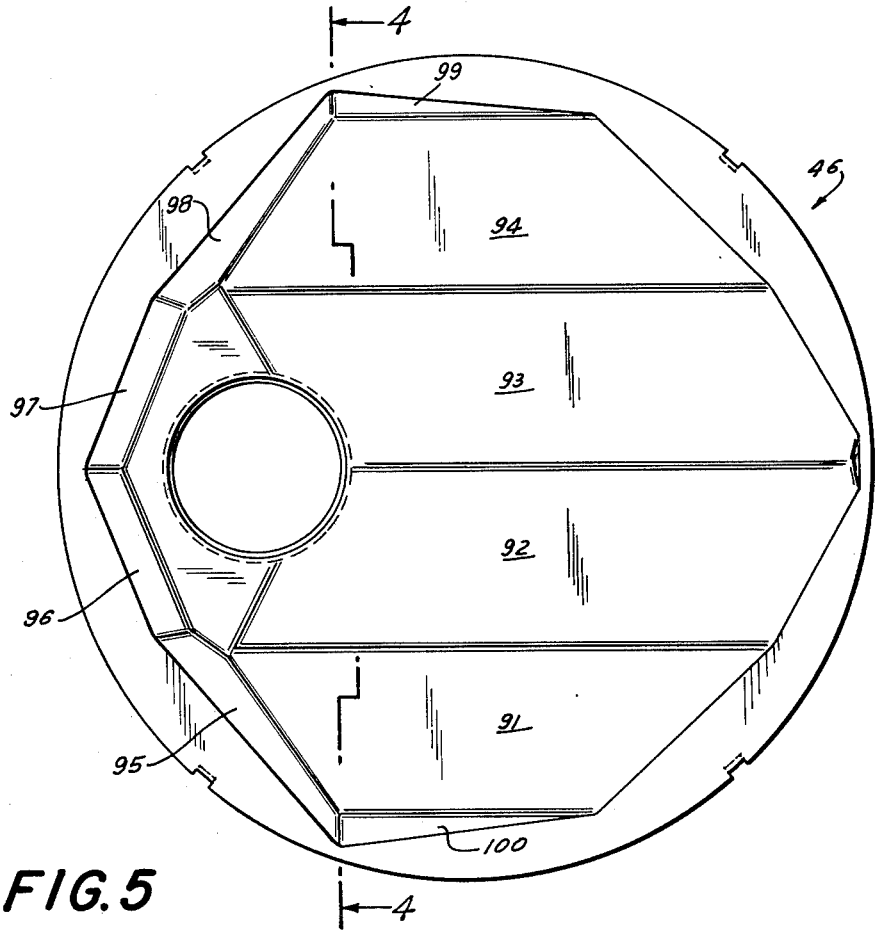
FIG. 5 is an enlarged bottom view of the reflector shown in FIGS. 2 and 3.

As indicated above, reflector 46 (see FIGS. 4, 5 and 6) is formed into a large number of facets each of which presents a flat reflecting surface. Those surfaces positioned and dimensioned as shown, and with bulb 37 positioned with its filament as shown, cause the lamp to produce substantially uniform lighting over a horizontal work surface extending from the left of edge 31 of the shade toward and beyond edge 33 and beyond the two sides of the shade. That lighted area can be reduced in size by lowering the lamp head and it can be increased in size by moving the lamp head upwardly. The drawings show the relative dimensions of the facets and the positioning of the bulb to scale, and also show the angular relationship between the facets. Referring to FIG. 5, there are four principal facets 91, 92, 93 and 94 which extend toward the right edge of the lamp shade in the general direction in which the illuminated area is enlarged. Those facets are at angles to each other as shown in FIG. 4 so that the side edges of those facets are not truly parallel. The facets 95, 96, 97 and 98 at the left of the bulb in FIG. 5 are slanted slightly from the vertical so as to tend to reflect the light somewhat downwardly, and they are at angles to each other so that the opposite edges of facets 95 and 98 extend to the right beyond the center of bulb 37. There are two minor facets 99 and 100 shown at the top and bottom in FIG. 5. These facets are generally triangular. The center of the filament is at point 101 so that that is the center of the zone where light is produced. The bulb is also frosted so that the light is diffused. The diffused light is directed toward the facets and also from the bottom portion of the bulb directly to the work surface. As indicated above, the lamp as disclosed provides substantially uniform lighting throughout the entire work area which is generally oval in shape. As represented in broken lines in FIG. 1, the direction of that oval relative to the lamp can be moved by turning the shade about its vertical pivot.

As indicated above, the lamp of the illustrative embodiment is suitable for use with overhead lighting to provide "local lighting" in work areas such as desks and other horizontal surfaces adjacent business machines or terminals, or manufacturing are being performed. The light is evenly distributed throughout the entire work area and there is an absence of glare. The overhead or general lighting can then be at a much lower level than is required in the absence of satisfactory local lighting. The intensity of the light can be adjusted within certain limits by moving the lamp head to and from the work area, that is, vertically when the work area is horizontal. The light is directed only to the work surface and the worker's eyes are thereby protected from excessive light. An important aspect of the invention is that the lamp head is normally positioned at one side or end of the work area. The lamp shade and reflector assembly can be turned about its vertical pivot axis 26 so as to give the single lamp a very substantial potential work area in any one position of the lamp head. Also, the lamp head can be moved throughout a wide range horizontally.

What is claimed is:

1. In a lamp construction, the combination of, an enclosure having a circular bottom opening with an annular ledge means surrounding said opening, support means positioned within said opening and having a portion overhanging said ledge and providing an opening concentric with the first-named opening and of lesser diameter, a shade having its top wall extending along the bottom of said support means and having an opening concentric with and of substantially the diameter of the second named opening, anti-friction means positioned between said flange and above the adjacent top surface of said lamp shade, and means attaching said lamp shade to said support means within the zone between the first-named and second-named of said openings.

2. The construction as described in claim 1 wherein said support means comprises a plastic ring and wherein said means attaching said shade thereto comprises a plurality of screws extending through openings in said shade and threaded into said ring.

3. The construction as described in either of claims 1 or 2 wherein said shade has an annular flange extending into said second-named opening.

4. The construction as described in claim 1 wherein said mating portion for said ledge means comprises an annular flange which is directed radially inwardly, bulb socket means rigidly mounted in said enclosure and having its axis concentric with the axis of said bottom opening, said enclosure having a side wall, and a support means mounted upon said side wall and projecting radially outwardly with respect to said axis.

5. The construction as described in claim 4 which includes a counter-balanced arm assembly support means.

6. The construction as described in claim 4 which includes an electric switch mounted on said enclosure and operative to control the supply of electricity to said bulb through said socket.

7. The construction as described in any of claims 1, 2 or 4 wherein said enclosure comprises a cylindrical portion with top ventilation openings therein formed by portions of said top wall which extend at predetermined angles downwardly from the top thereof.

8. The construction as described in claim 1 which includes a support arm rigidly attached to said enclosure, a support bracket extending longitudinally with respect to said support arm, pivot means rockably mounting said support arm upon said support bracket, and means to adjust said support arm with respect to said bracket on said pivot means which comprises spring means urging said support arm in one direction and threaded means which is adjustable to limit the rocking movement of said support arm in the other direction.

9. The construction as described in any of claims 1, 2 or 4 which includes a sheet metal reflector positioned within said shade and having a periphery which mates with the periphery of the bottom of said shade, said shade having an annular recess directly above said periphery of said shade, and strip means having an upper portion which is snugly received in said recess and a bottom portion which is positioned below said periphery of said reflector and which holds said reflector in said shade.

10. In a lamp construction, the combination of, a shade and reflector assembly having a cylindrical side wall and a substantially flat top wall with a circular opening in said top wall adjacent one edge thereof and mounting means for said shade to permit said shade to turn about the axis of said opening including annular interengaging flange means surrounding said opening, and a reflector positioned below said top wall and within said cylindrical wall and having an outer periphery mating with and fixed to the bottom edge of said cylindrical wall, said reflector having an opening which is concentric with the first mentioned opening, said reflector having a plurality of facets each of which is substantially flat and which reflects the light in the vicinity of the axis of said openings downwardly in a controlled pattern to produce substantially uniform lighting throughout a work area beneath said reflector which extends from an area substantially directly below the edge of said reflector adjacent said openings to an area substantially beyond a position directly below the opposite edge of said reflector.

* * * * *